US005882169A

United States Patent [19]

Tucek

[11] Patent Number: 5,882,169

[45] Date of Patent: Mar. 16, 1999

[54] GOLF BALL RETRIEVING ASSEMBLY

[76] Inventor: Milan P. Tucek, 72 Old Cleveland Road., Capalaba, Queensland, 4157, Australia

[21] Appl. No.: 666,439

[22] PCT Filed: Dec. 7, 1994

[86] PCT No.: PCT/AU94/00757

§ 371 Date: Jun. 24, 1996

§ 102(e) Date: Jun. 24, 1996

[87] PCT Pub. No.: WO95/17929

PCT Pub. Date: Jul. 6, 1995

[30] Foreign Application Priority Data

Dec. 24, 1993 [AU] Australia ..... PM 3182

[51] Int. Cl.[6] ..... B60P 1/00

[52] U.S. Cl. ..... 414/440

[58] Field of Search ..... 414/434, 435, 414/437, 439, 440

[56] References Cited

U.S. PATENT DOCUMENTS

| | | | |
|---|---|---|---|
| 2,365,540 | 12/1944 | Fonken | 414/440 |
| 2,605,005 | 7/1952 | Wenzel et al. | 414/440 |
| 2,656,061 | 10/1953 | Lockie | 414/440 |
| 2,658,637 | 11/1953 | Bailey | 414/440 |
| 2,792,955 | 5/1957 | Sumner | 414/440 |
| 2,812,871 | 11/1957 | Woodall | 414/440 |
| 3,102,647 | 9/1963 | Bonney | 414/440 |
| 3,175,714 | 3/1965 | Wittek | 414/440 |
| 3,362,551 | 1/1968 | Shoemaker | 414/440 |
| 3,784,037 | 1/1974 | Woodall | 414/440 |
| 3,823,838 | 7/1974 | Gustafson et al. | 414/440 |
| 3,995,759 | 12/1976 | Hollrock et al. | 414/440 |
| 4,158,418 | 6/1979 | Hayashi | 414/440 |
| 4,792,271 | 12/1988 | Akel | 414/440 |
| 5,087,105 | 2/1992 | Akel | 414/440 |
| 5,141,383 | 8/1992 | Phillips et al. | 414/440 |

*Primary Examiner*—James W. Keenan

*Attorney, Agent, or Firm*—Renner, Otto, Boisselle & Sklar P.L.L.

[57] ABSTRACT

A golf ball retrieving system has a plurality of collector wheels attached to pivoting arms to allow the wheels to track a ground surface, adjacent wheels being spaced apart by a distance equivalent to the diameter of a golf ball to allow golf balls to be picked up between adjacent wheels as well as by the wheels themselves.

4 Claims, 6 Drawing Sheets

GOLF BALL RETRIEVING ASSEMBLY

FIELD OF THE INVENTION

THIS APPLICATION relates to a golf ball retrieving assembly which can be pushed or pulled over a fairway to collect golf balls therefrom.

BACKGROUND ART

To facilitate collection of a large number of golf balls from a fairway, it is known to use golf ball retrievers. One type of golf ball retriever utilises a number of spaced discs mounted onto a common shaft. The spacing of the discs corresponds to the width of a golf ball so that as the discs move over a ground surface, golf balls are caught between adjacent discs. The golf balls are subsequently dislodged by a dislodging finger and are transferred to a collecting basket. The discs can either be ground engaging or can be mounted to a common shaft which terminates with a pair of ground engaging wheels to space the discs slightly above the ground surface. Devices of this type are disclosed in the following U.S. Pat. Nos. 3,995,759 (Hollrock), 3,823,838 (Gustafsson), 3,175,714 (Wittik), 2,792,955 (Summer), 2,365,540 (Fonken) and 4,792,271 (Akel).

Such retrievers suffer from a number of disadvantages. Firstly, to pick up golf balls the discs must be relatively closely spread and to allow efficient retrieving of golf balls from a fairway, a large number of discs are required spaced along a shaft. This increases the overall cost of the apparatus and increases its weight and therefore makes it unsuitable for use on certain fairways.

To overcome the above disadvantages, golf ball retrievers have been developed comprising a number of spaced collector wheels mounted to a common shaft with golf ball deflecting members being located between adjacent collector wheels to deflect golf balls towards a respective collector wheel. This obviated the requirement for a large number of discs or collector wheels to be present on the retriever as the deflector members would channel golf balls to a respective collector wheel. Examples of this type of retriever are found in the following U.S. Pat. Nos. 2,658,637 (Bailey), 3,784,037 (Woodall), 2,812,871 (Woodall), 4,158,418 (Hayasahi) and 2,656,061 (Luckie).

A disadvantage with both the abovementioned known types of retrievers is that the discs or wheels are mounted to a common shaft which means that the discs or collector wheels are suitably only on relatively level surfaces and cannot track undulations in the ground surface.

For instance, golf balls tend to collect within small depressions or pockets in a fairway and the retrievers described above are not generally capable of entering into a pocket or depression to collect the golf balls but instead merely pass over the pocket or depression.

U.S. Pat. No. 2,605,005 (Wenzel) attempts to overcome the abovementioned disadvantage by providing a number of spaced collector wheels which are independently pivotally mounted to a cross bar. This allows each individual collector to track undulations in a ground surface independent of each other collector wheel. Guide members are spaced between collector wheels to guide golf balls to a respective collector wheel for retrieval.

A serious disadvantage with the Wenzel retriever is that the guide arms are rigidly attached to the retriever and are not able to track undulations in the surface independently of its respective collector wheel. As a consequence, the guide members tend to dig into the fairway surface when passing through an undulation or pockets which results in damage to the fairway, damage to the retrieving device, and clogging of the collector wheels with dirt and debris.

A similar disadvantage is found with golf ball retrievers having collector wheels spaced along a common axle and deflector members located between adjacent collector wheels although in the latter situation, the deflectors do not generally get damaged or dig into the fairway surface as these retrievers are not able to collect balls from pockets or depressions in a fairway.

Other retrievers are found in U.S. Pat. Nos. 4,157,141 (Ryan) (utilizing a mat system), 3,102,647 (Bonney), French patent 2443-851 (utilising a paddle assembly) and U.S. Pat. No. 2,413,679 (Binder).

My earlier U.S. Pat. No. 5,141,383 describes a golf ball retriever having a number of collector wheels, each wheel being mounted to a separate arm which is pivotally coupled to a transverse frame member. The collector wheels are axially spaced apart, and to prevent golf balls from passing between collector wheels, deflecting assemblies are provided which are also pivotally mounted. While this retriever efficiently tracked the ground surface, in practice it was found to be relatively heavy due in part to the existence of two deflectors per collector wheel. Thus, for a typical fifteen wheel assembly, about twenty-eight deflectors were required.

OBJECT OF THE INVENTION

The present invention is directed to a golf ball retrieving apparatus which does not require deflectors to deflect golf balls to a collector wheel, thereby providing savings in cost and weight, and where the collector wheels are still able to track the ground surface (unlike the known retrievers which utilities spaced discs mounted to a common axle).

It is a further object of the invention to provide a frame assembly which can couple golf ball retrieving assemblies together.

In one form the invention resides in a golf ball retrieving assembly moveable across a ground surface in a forward direction, the assembly comprising a transversely extending frame member, a plurality of axially spaced ground engageable collector wheels having recesses to accept and retain golf balls therein, means to connect the collector wheels relative to the frame member such that the collector wheels can track undulations in a ground surface, the means including a plurality of separate collector wheels support arms, each arm supporting at least one collector wheel for rotation, the arms being able to move independently to each other, characterised in that adjacent collector wheels are spaced apart by a distance to allow a golf ball to be accepted and retained by outer walls of the adjacent collector wheels as well as by the recess in the wheel.

By ensuring that the spacing between a pair of adjacent collector wheels is such to pick up a golf ball, the need for providing deflectors to deflect golf balls to a collector wheel is eliminated. If adjacent collector wheels are mounted on separate support arms, the adjacent collector wheels can independently track a ground surface (for instance, the wheels can independently move along vertical planes), and the spacing between the collector wheels will remain substantially unaltered thereby allowing the outer wall of each wheel to grip a golf ball.

The collector wheels may be injection-moulded from a suitable plastic and suitably are formed from two half-discs which are joined together to form the collector wheel.

The recess to accept and retrieve golf balls may comprise a peripheral channel extending about the collector wheel, the channel being defined between two end walls of the wheel, the spacing between the two end walls being sufficient to accept and grip a golf ball. It is preferred that the end walls are formed from resilient plastic to enhance the ability of the wheel to grip the golf ball with minimal damage to the wheel or the golf ball.

The support arms may have one end pivotally mounted to the transversely-extending frame member so as to be moveable up and down. The other end of each arm member may be provided with an axle to which at least one, and preferably two, collector wheels are rotatably mounted. If a pair of wheels are mounted to the axle, it is preferred that the wheels are on each side of the support arm. If a pair of wheels are provided, these wheels are preferably spaced parallel to each other, and are spaced apart by a distance equating to the diameter of a golf ball such that golf balls can be collected both by the recesses in the collector wheels, and by the space between the collector wheels.

The support arms can be spaced along the transversely extending frame member such that a collector wheel mounted to one support arm is spaced from the collector wheel mounted to an adjacent support arm by a distance corresponding to the diameter of a golf ball such that a golf ball can also be accepted and retrieved by this spacing as well as the spacing between a pair of collector wheels mounted to a single support arm, and the recess within each collector wheel itself.

In another form, the invention resides in a golf ball retrieving assembly moveable across a ground surface in a forward direction, said assembly comprising a transversely extending frame member, a plurality of axially spaced ground engageable collector wheels having recesses to accept and retain golf balls therein, means to connect the collector wheels relative to the frame member such that the collector wheels can track undulations in a ground surface, the means comprising a support arm pivotally connected adjacent one end to the frame member, the other end of the support arm supporting at least two collector wheels, the wheels being spaced apart such that a golf ball can be accepted and retrieved by engagement with the walls of the spaced apart collector wheels.

In another form the invention resides in a frame assembly to couple golf ball retrieving units together, the frame assembly comprising a pair of longitudinal frame members adapted to extend forward of a vehicle, first means to pivotally couple the frame members to the vehicle to allow the frame members to move up and down, the frame members converging to a forward point area, second means to pivotally couple a front retrieving unit to the forward point of the assembly, and third means to pivotally couple a side retrieving unit to each side of the longitudinal frame members.

BRIEF DESCRIPTION OF THE DRAWINGS

The invention will be described with reference to the accompanying drawings in which.

BEST MODE

Figure 1:
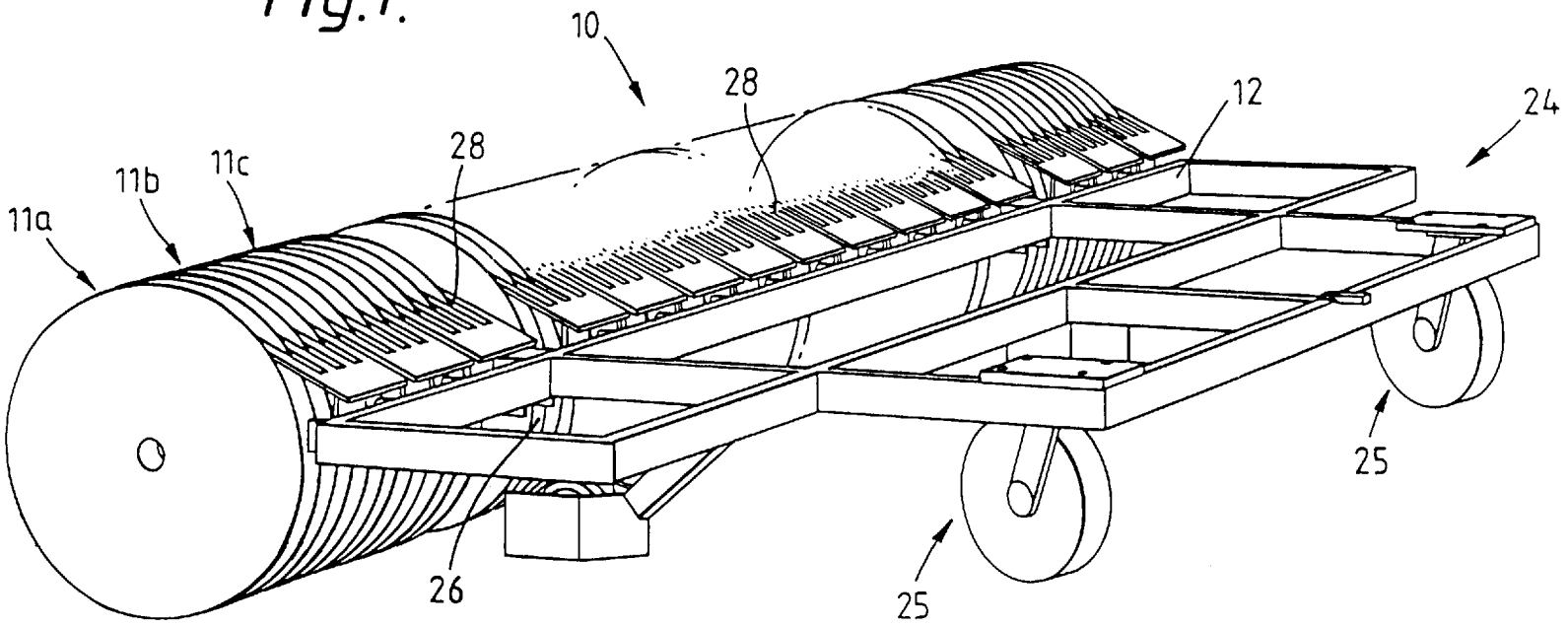
FIG. 1 is a golf ball retrieving assembly according to an embodiment of the invention.

Referring to the drawings and initially to FIG. 1, there is illustrated a golf ball retrieving assembly 10, the assembly comprising a plurality of axially spaced ground engageable collector wheels 11*a–c* (FIG. 1 showing sixty collector wheels). The retrieving assembly includes a transversely extending frame member 12 to which the wheels 11*a–c* are coupled in a manner more clearly illustrated with reference to FIG. 2.

Figure 2:
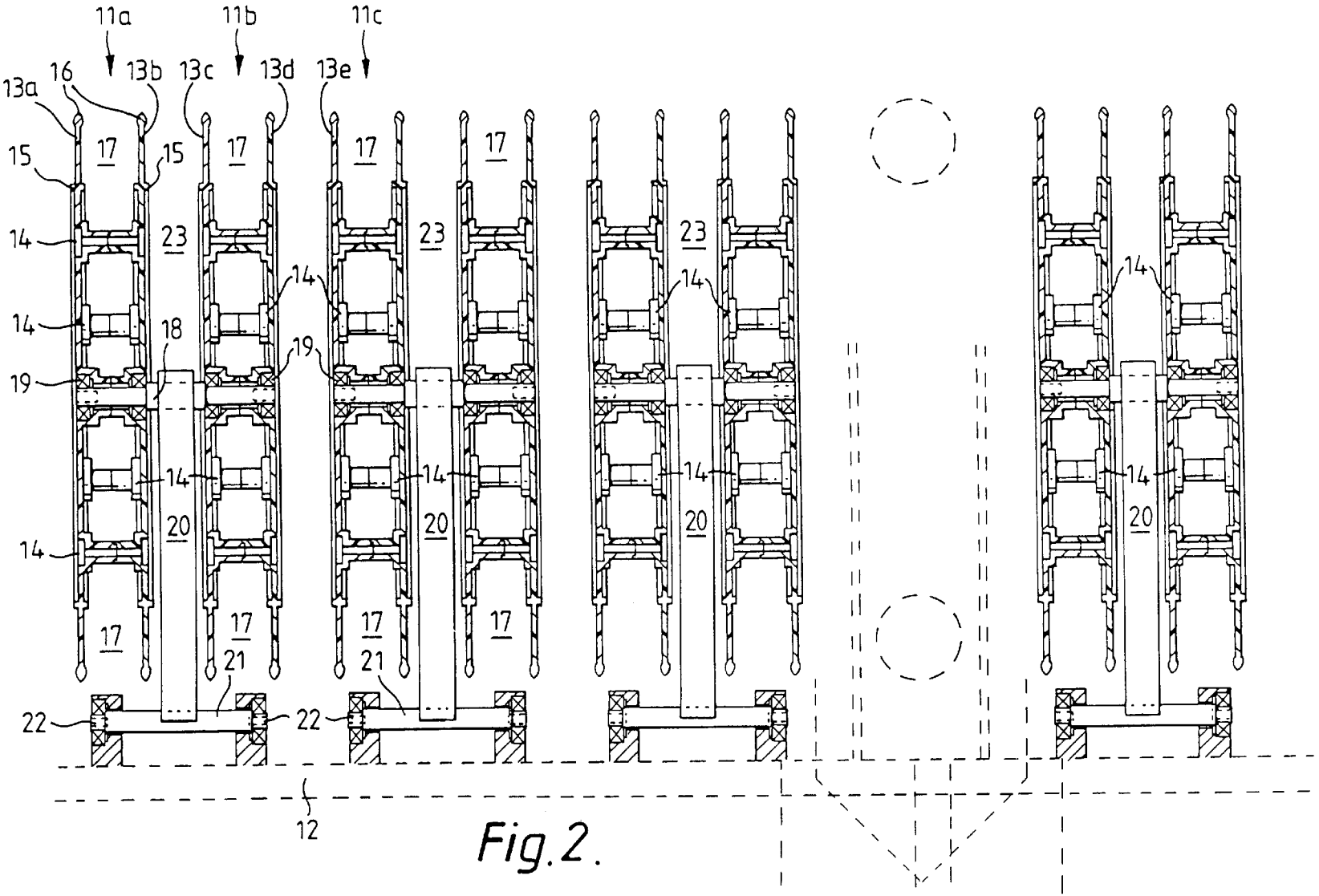
FIG. 2 is a plan part section view of the assembly of FIG. 1.

Referring to FIG. 2, there is illustrated the assembly of FIG. 1 in plan. Collector wheels 11*a–c* each comprise a pair of wheel halves 13*a*, 13*b* which are separately injection-moulded from a plastic such as polypropylene and are coupled together through fasteners 14. Each wheel half is formed with a shoulder 15 and a thickened outer lip 16. Shoulder 15 and the portion of the wheel half from the shoulder to lip 16 defines a recess or channel 17 which is dimensioned to allow a golf ball to be accepted and retrieved therein. Thus, as wheel 11*a* travels over a ground surface, it can pass over a golf ball causing lips 16 to slightly bend outwardly to grip the golf ball within channel 17. Further rotation of the wheel will then remove the golf ball from the fairway surface. This is similar to the arrangement described in my earlier U.S. Pat. No. 5,141,383. The thickened lips 16 function to prevent premature wear and tear on the rim of the wheel.

A pair of collector wheels 11*a*, 11*b* are mounted to a transversely extending axle 18 through bearings 19 such that wheels 11*a*, 11*b* can freely rotate about axle 18. Axle 18 is mounted to one end of a wheel support arm 20. The other end of wheel support arm 20 is connected to a transversely extending shaft 21 which is mounted for rotation by bearing housings 22. Shaft 21 can therefore freely rotate about its longitudinal axis which in turn allows wheel support arm 20 to move up and down. Thus, it can be seen that the collector wheels 11*a*, 11*b* can track undulations in a ground surface as they rotate. However, wheels 11*a* and 11*b* can not independently track undulations as they are mounted to common axle 18.

To prevent golf balls from passing between wheels 11*a* and 11*b*, these wheels are spaced apart by a golf ball diameter. Thus, wall 13*b* of wheel 11*a* and wall 13*c* of wheel 11*b* can also grip a golf ball therebetween. Thus, there is no need to provide a deflector to deflect balls away from this space and to channels 17.

FIG. 2 shows a plurality of wheel support arms 20 each independently coupled to transversely extending frame member 12 such that each arm 20 can move independently from each other arm. Each arm rotatably supports a pair of collector wheels so that each pair of wheels can track undulations in the ground surface independently from each adjacent pair of wheels. To prevent golf balls from passing between collector wheels 11*b* and 11*c*, these wheels are spaced apart by a distance to grip any golf ball which passes between the wheels. Thus, walls 13*d* and 13*e* are spaced apart to grip a golf ball. Shoulders 15, as well as extending into each collector wheel, also projects outwardly from each collector wheel to define inter-wheel channels 23.

When the assembly as illustrated in FIG. 2 is pushed or pulled over a fairway, golf balls will be trapped within a channel 17, within the channel 23 between a pair of collector wheels 11*a*, 11*b* and within channel 23 defined between collector wheels 11*b* and 11*c*. Therefore, there is no part of the assembly which will be unable to pick up golf balls. The collector wheels (or at least pairs of collector wheels) can track undulations in a ground surface independently of adjacent collector wheels (which are mounted to a further support arm 20). This arrangement does away with the need for deflectors as is described in my earlier U.S. Pat. No. 5,141,383.

Figure 3:
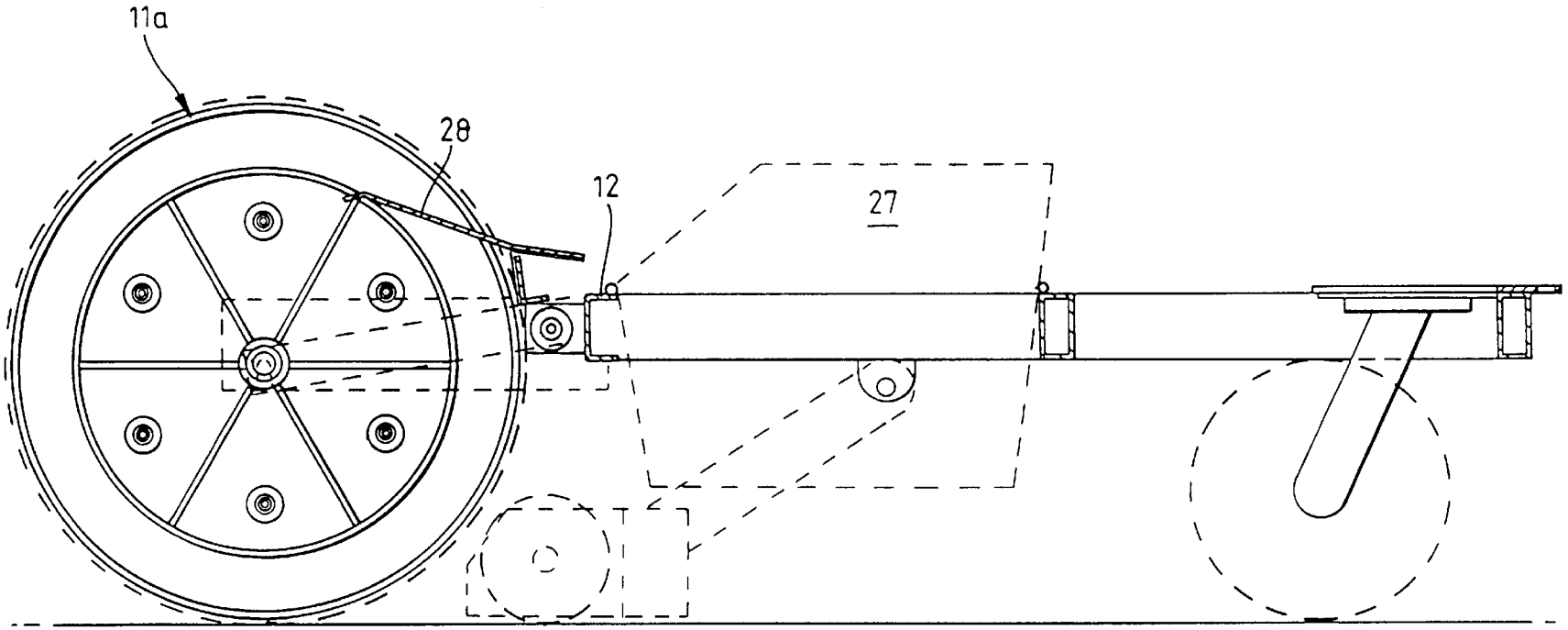
FIG. 3 is a side view of the assembly of FIG. 1.

Referring to FIG. 1, the transversely extending frame member 12 forms part of a framework assembly 24 which comprises a jockey wheel 25. The framework 24 also includes rectangular recesses 26 in which baskets 27 (see FIG. 3) can locate, the baskets holding retrieved golf balls.

To dislodge golf balls from a respective channel 17 or 23, there are provided dislodging fingers 28 which pass into channel 17 and 23 to dislodge golf balls therefrom as the collecting wheel 11*a–c* rotates. The dislodging fingers are configured such that a dislodged golf ball will travel over the top of a finger 28 and into basket 27.

Figure 4B:
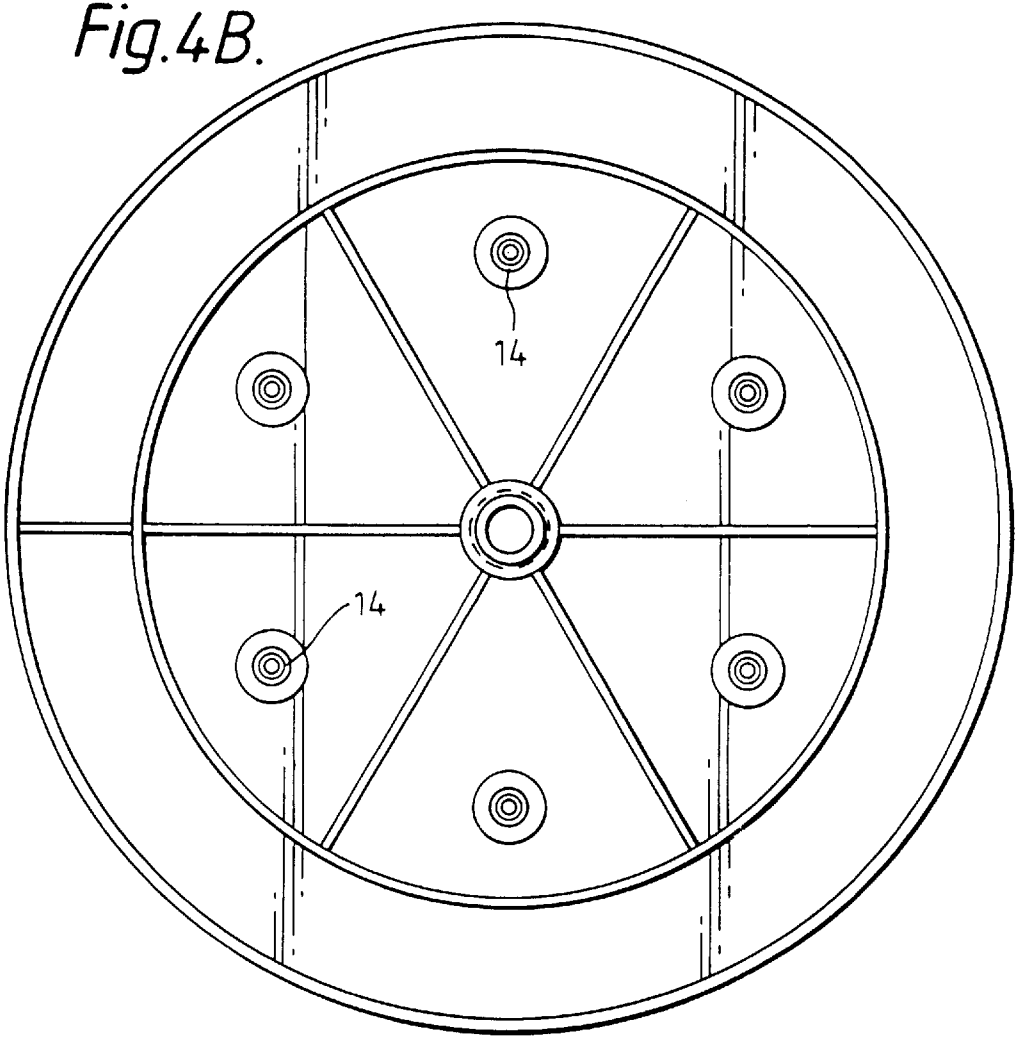
FIGS. 4A and 4B are end and side views of part of a collector wheel.
Figure 4A:
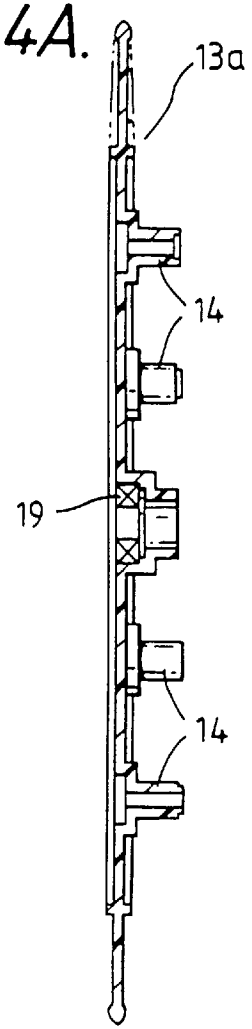

FIGS. 4A and 4B illustrate a collector wheel half. FIG. 4A shows a plastic injection-moulded half wheel which can be bolted to an identical second half wheel to provide a collector wheel. This arrangement is cheaper than injection moulding an entire wheel. The two halves are bolted together through six bolt holes better illustrated in FIG. 4B. The central part of the wheel accepts an axle and a bearing housing 19.

Figure 5:
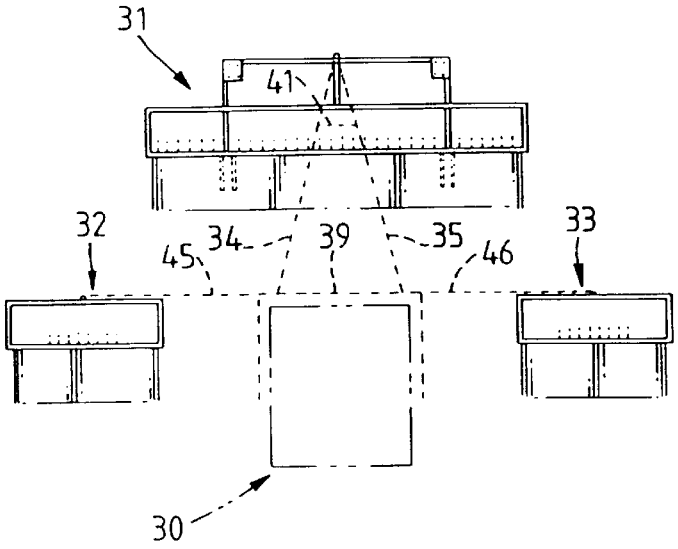
FIG. 5 is a schematic plan view of a number of retrieving units coupled together by a frame assembly according to an embodiment of the invention.
Figure 6:
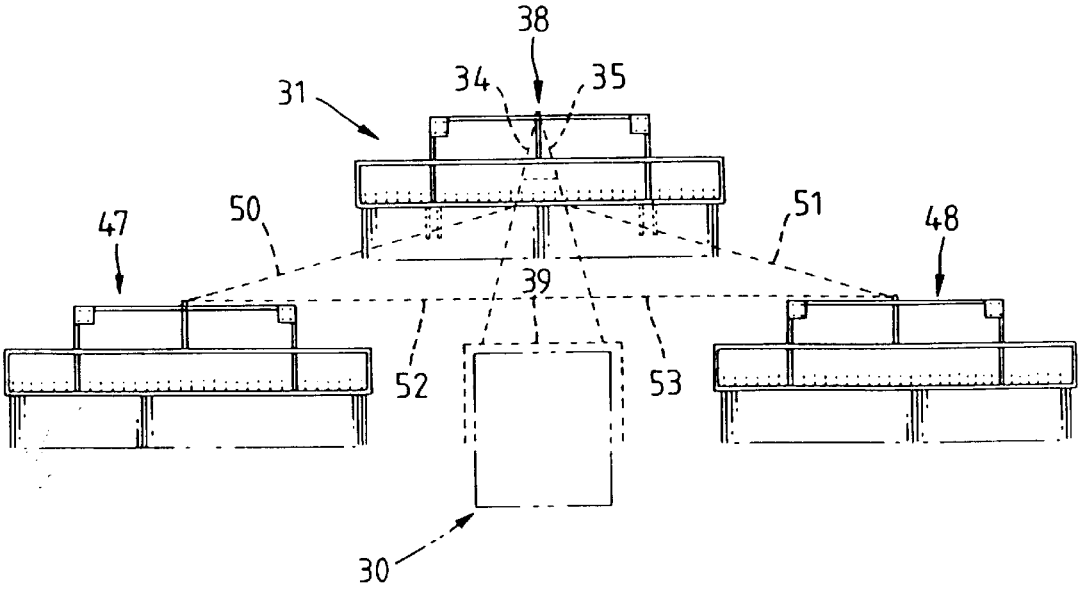
FIG. 6 is a plan schematic view of an alternative arrangement of retrieving units coupled together by a frame assembly according to an embodiment of the invention.
Figure 7:
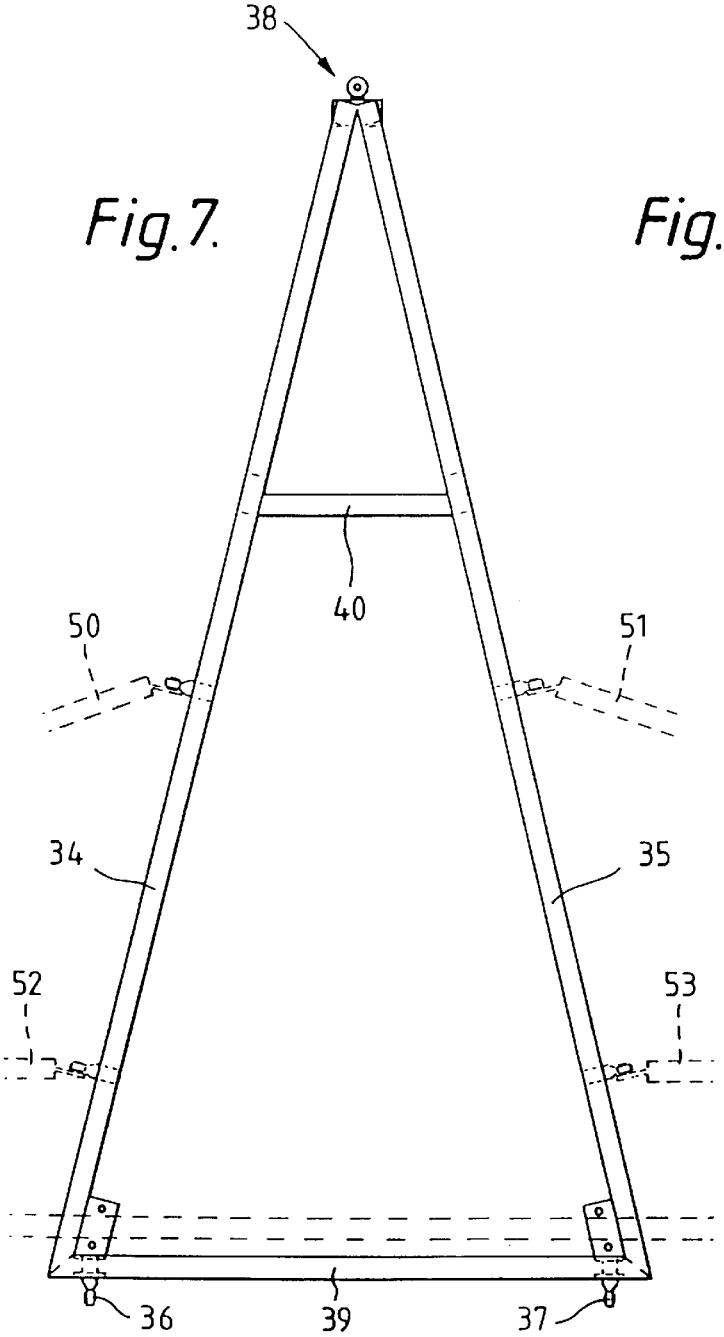
FIG. 7 is a plan view of the frame assembly according to an embodiment of the invention.
Figure 8:
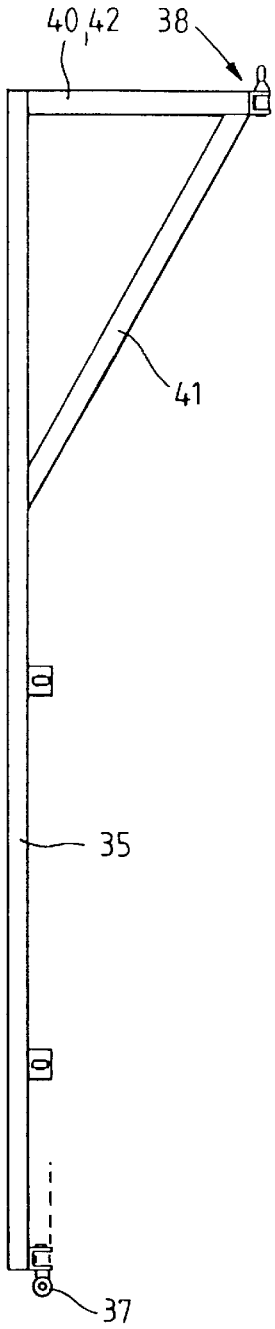
FIG. 8 is a side view of the frame of FIG. 10.
Figure 9:
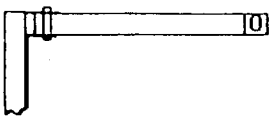
FIG. 9 is a side view of a connector of the frame assembly.
Figure 10:
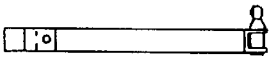
FIG. 10 is an end view of FIG. 9.

FIGS. 5 and 6 illustrate two arrangements of golf ball retrieving assemblies. In both figures, a vehicle such as a tractor 30 is used to move the assemblies over the fairway.

In FIG. 5 there is illustrated a forward retrieving assembly 31 which is of a longer width, and a pair of opposed side retrieving units 32, 33 of smaller width. FIG. 6 illustrates a similar arrangement showing three retrieving assemblies of equal width. In FIGS. 5 and 6 the wider unit has a width of 9.5 meters while the smaller units have a width of 1.2 meters.

The retrieving units are coupled together using a frame assembly which is illustrated in FIGS. 7 to 10 and is also illustrated in phantom in FIGS. 5 and 6. The frame assembly allows each retrieving unit to be trailed from a mounting point, but still allows a retrieving unit to be in front of tractor 30. Thus, tractor 30 itself does not run over golf balls before a retrieving unit has an opportunity to collect the golf balls. The frame assembly as illustrated in FIGS. 7 to 10 facilitates this function. It is important to note that the retrieving units trail from the mounting point and thus are being pulled rather than pushed. It is found that pushing retrieving units from a rear area is difficult, especially with steering. However, merely trailing the unit behind a tractor causes many golf balls to be pushed into the fairway surface by the tractor wheels.

The frame assembly comprises a pair of longitudinal frame members 34, 35 which extend forward of tractor 30 and which are pivotally coupled thereto through pivot points 36, 37. The frame assembly can therefore move up and down relative to the tractor (that is, can tract undulations in a ground surface). Frame members 34, 35 converge to a forward point 38. The rear of frame members 34, 35 are inter-connected by a transverse strut 39 to provide rigidity to the arrangement, and an intermediate strengthening strut 40 is also provided. Forward point 38 is pivotally coupled to a forward retrieving unit (see, for instance, 31 in FIGS. 5 and 6) and frame members 34, 35 pass over the top of retrieving unit 31. A vertical strut 42 extends downwardly from the forward portion of frame members 34 and 35, and a diagonal strut 41 is also provided for strength.

When smaller retrieving units are located on each side of tractor 30 (see FIG. 5) these can be connected by transverse frame members 45, 46 which extend outwardly from each side of frame members 34, 35 and adjacent a base portion thereof. These members can be coupled to a forward portion of retrieving units 32, 33 by coupling pins.

For larger side units as illustrated in FIG. 6 (side units 47, 48 being approximately 9.5 meters wide), the coupling arrangement includes diagonal struts 50, 51 as well as transverse struts 52, 53. This arrangement provides greater strength in pushing side units 47, 48. As the larger side units have a larger framework, struts 45, 46 are not suitable and struts 52, 53 which are connected further along side frame members 34, 35 must be used.

It should be appreciated that various other changes and modifications may be made to the embodiment described without departing from the spirit and scope of the invention.

I claim:

1. A golf ball retrieving assembly moveable across a ground surface in a forward direction, the assembly comprising:

a transversely extending frame member, at least two spaced apart trailing support arms mounted to said transversely extending frame member for movement in a vertical plane relative to said transversely extending frame member, each of the support arms having one end pivotally attached to the frame member, and having an axle attached to and extending from each side of the other end of each of the support arms, and, at least one ground engageable collector wheel mounted to each said axle thereby allowing said collector wheel to track undulations in the ground surface upon movement of the retrieving assembly in the forward direction, the at least one collector wheel having a recess to accent and retain golf balls therein, wherein each said collector wheel has an outer wall, the outer walls of said collector wheels spaced apart to allow a golf ball to be picked up by being gripped by the outer walls of said collector wheels.

and wherein adjacent support arms are spaced apart such that a said collector wheel on one support arm and a said collector wheel on the adjacent support arm are spaced apart by a distance corresponding to the diameter of a golf ball such that a golf ball can be picked up by being gripped by the walls of the said collector wheels of the said one support arm and the said adjacent support arm.

2. The apparatus of claim 1, wherein the recess in each collector wheel is a peripheral annular recess.

3. The apparatus of claim 2, wherein each collector wheel is formed from two halves which are fastened together.

4. The assembly of claim 3, including golf ball dislodging fingers extending into the recesses to dislodge golf balls from the recess.

* * * * *